US007711136B2

(12) United States Patent
Zhang et al.

(10) Patent No.: US 7,711,136 B2
(45) **Date of Patent: *May 4, 2010**

(54) MICROPHONE ARRAY IN HOUSING RECEIVING SOUND VIA GUIDE TUBE

(75) Inventors: Ming Zhang, Cupertino, CA (US); Bo Zhang, Nanjing (CN); Lili Chen, Nanjing (CN)

(73) Assignee: Fortemedia, Inc., Cupertino, CA (US)

( * ) Notice: Subject to any disclaimer, the term of this patent is extended or adjusted under 35 U.S.C. 154(b) by 516 days.

This patent is subject to a terminal disclaimer.

(21) Appl. No.: 11/564,869

(22) Filed: Nov. 30, 2006

(65) Prior Publication Data

US 2007/0127759 A1 Jun. 7, 2007

Related U.S. Application Data

(60) Provisional application No. 60/742,033, filed on Dec. 2, 2005, provisional application No. 60/748,276, filed on Dec. 7, 2005.

(51) Int. Cl.
*H04R 9/08* (2006.01)

(52) U.S. Cl. ..... 381/357; 381/356

(58) Field of Classification Search ..... 381/313, 381/322, 350, 356, 357
See application file for complete search history.

(56) References Cited

U.S. PATENT DOCUMENTS

| | | | | |
|---|---|---|---|---|
| 7,013,014 | B2 * | 3/2006 | Ach-Kowalewski et al. | 381/313 |
| 7,151,839 | B2 * | 12/2006 | Niederdrank | 381/322 |
| 2004/0052388 | A1 | 3/2004 | Niederdrank | |
| 2004/0184630 | A1 | 9/2004 | Ach-Kowalewski et al. | |

FOREIGN PATENT DOCUMENTS

| | | | |
|---|---|---|---|
| CN | 1290467 | A | 4/2001 |
| TW | 391401 | Y | 5/2000 |
| WO | 9933324 | A1 | 7/1999 |

OTHER PUBLICATIONS

TW office action mailed Nov. 5, 2009.
English abstract of TW391401, pub. May 21, 2000.

* cited by examiner

*Primary Examiner*—Brian Ensey
(74) *Attorney, Agent, or Firm*—Thomas, Kayden, Horstemeyer & Risley

(57) ABSTRACT

An electronic device includes a housing, a plurality of microphones, and a plurality of guide tubes. The plurality of microphones are disposed in the housing. The plurality of guide tubes extend from the housing toward the plurality of microphones, whereby the plurality of microphones in the housing receives external sound via the guide tubes.

15 Claims, 6 Drawing Sheets

MICROPHONE ARRAY IN HOUSING RECEIVING SOUND VIA GUIDE TUBE

CROSS REFERENCE TO RELATED APPLICATIONS

This application claims the benefit of U.S. Provisional Application No. 60/742,033, filed on Dec. 2, 2005, and U.S. Provisional Application No. 60/748,276, filed on Dec. 7, 2005.

BACKGROUND OF THE INVENTION

1. Field of the Invention

The invention relates to a microphone array in a housing receiving sound via guide tubes.

2. Description of the Related Art

A microphone array includes a number of microphones disposed in tandem. A simple example is shown in FIG. 1, wherein the microphone array 10 includes two microphones 11 and 12 placed side by side. Directivity of the microphone array 10 can be achieved by manipulating the signal received by the two microphones 11 and 12. Assuming the two microphones 11 and 12 are omni-directional and having the same characteristics, the directivity of the microphone array 10 depends on vector $\vec{d}$ from one microphone 11 to the other microphone 12.

The above-mentioned microphones 11 and 12 are conventionally placed in an open space to achieve directivity. Most electronic devices (cellular phones, personal digital assistants, etc.), however, have plastic or metal housings, acting as acoustic isolators which block audio signals, thus increasing the difficulty of microphone placement. Furthermore, the majority of electronic elements including microphones are conventionally surface-mounted on printed circuit boards (PCBs), thus limiting the directivity of the microphone array. As illustrated by FIG. 2, microphones 11' and 12' are disposed in a housing 20. The housing 20 acts as an acoustic isolator preventing the microphones 11' and 12' from receiving external sound. Furthermore, the distance d1 between the microphones 11' and 12' on the PCB 21 is limited by the available space on the PCB 21 and in the housing 20, generally being less than the desired distance (d1<d). Furthermore, the direction of the microphone array, as designated by vector $\vec{d1}$, is always parallel to the PCB 21. Such a direction, however, does not necessarily target the desired sound source during operation of the electronic device.

BRIEF SUMMARY OF THE INVENTION

The invention provides a microphone array in a housing of an electronic device, capable of preventing the described problems.

The electronic device includes a housing, a plurality of microphones, and a plurality of guide tubes. The plurality of microphones are disposed in the housing. The plurality of guide tubes extend from the housing toward the plurality of microphones, whereby the plurality of microphones in the housing are capable of receiving external sound via the guide tubes.

The electronic device may further include a plurality of acoustically isolated chambers disposed in the housing preventing sound transmission therebetween, wherein the plurality of microphones are disposed in the plurality of chambers in a one-to-one manner.

The housing may have a plurality of acoustic openings, with the plurality of guide tubes extending from the plurality of acoustic openings to the plurality of chambers. The acoustic openings may be provided on the top, bottom, or sides of the housing.

The plurality of acoustic openings may be separated by a first distance, and the plurality of microphones separated by a second distance less than the first distance.

The plurality of microphones may include unidirectional microphones, omni-directional microphones, or combinations thereof.

The guide tubes may be equal in length.

The guide tubes may differ in length.

The electronic device may be a cellular phone, an audio recorder, a personal digital assistant (PDA), or other device.

The electronic device may further include a circuit board, with the plurality of microphones mounted on the same side of the circuit board, or on opposite sides of the circuit board.

The plurality of microphones may be placed side-by-side.

The plurality of microphones may be placed back-to-back, in alignment or out of alignment.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
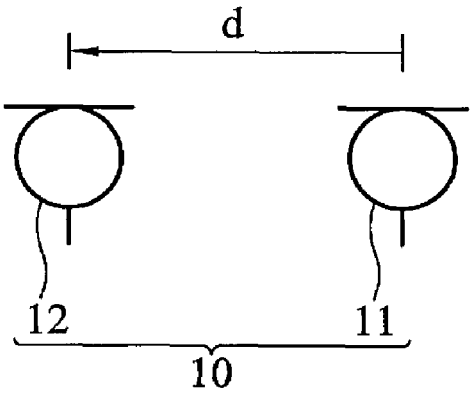
FIG. 1 (RELATED ART)
FIG. 1 is a schematic diagram of a microphone array.
Figure 2:
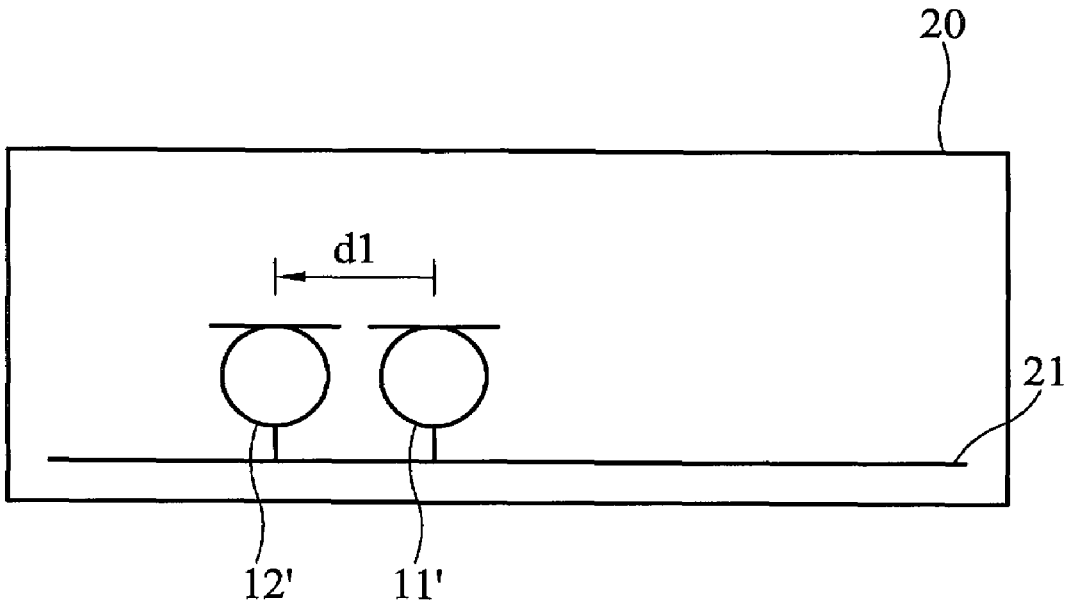
FIG. 2 (RELATED ART)
FIG. 2 is a schematic view of a microphone array disposed in a housing of an electronic device.
Figure 3:
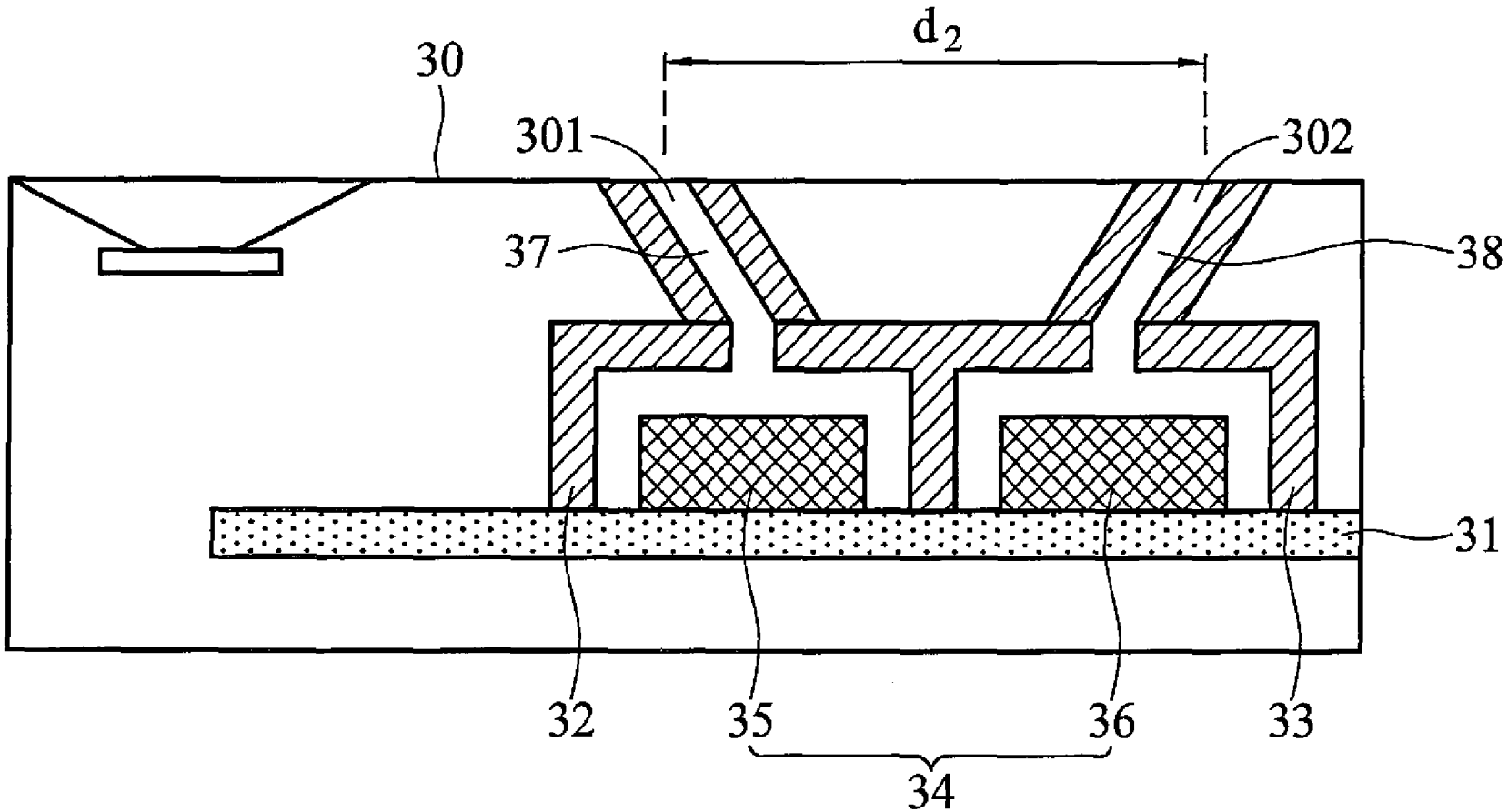
FIG. 3 depicts an electronic device in accordance with an embodiment of the invention.

Referring to FIG. 3, an electronic device in accordance with an embodiment of the invention comprises a housing 30, a printed circuit board (PCB) 31, a plurality of microphones 35 and 36, a plurality of chambers 32 and 33, and a plurality of guide tubes 37 and 38. All of the elements 31, 32, 33, 35, 36, 37, and 38 are disposed in the housing 30.

In this embodiment, the microphones 35 and 36, disposed in the chambers 32 and 33 in a one-to-one manner, are omni-directional. The guide tubes 37 and 38 are equal in length and extend from the chambers 32 and 33 to the acoustic openings 301 and 302 of the housing 30. Thus, the microphones 35 and 36 are capable of receiving external sound via the guide tubes 37 and 38. The chambers 32 and 33 are acoustically isolated from each other to prevent sound transmission therebetween.

The microphones 35 and 36 are placed side-by-side and surface-mounted on the same side of the PCB 31. The microphones 35 and 36 constitute a microphone array 34. The directivity of the microphone array 34 is determined by the acoustic openings 301 and 302 rather than the microphones 35 and 36. Such an arrangement is advantageous in achieving the directivity of the microphone array 34 since the acoustic openings 301 and 302 can be separated by a distance d2 greater than the microphones 35 and 36. In this embodiment, the acoustic openings 301 and 302 are provided at the top of the housing 30.

Figure 4:
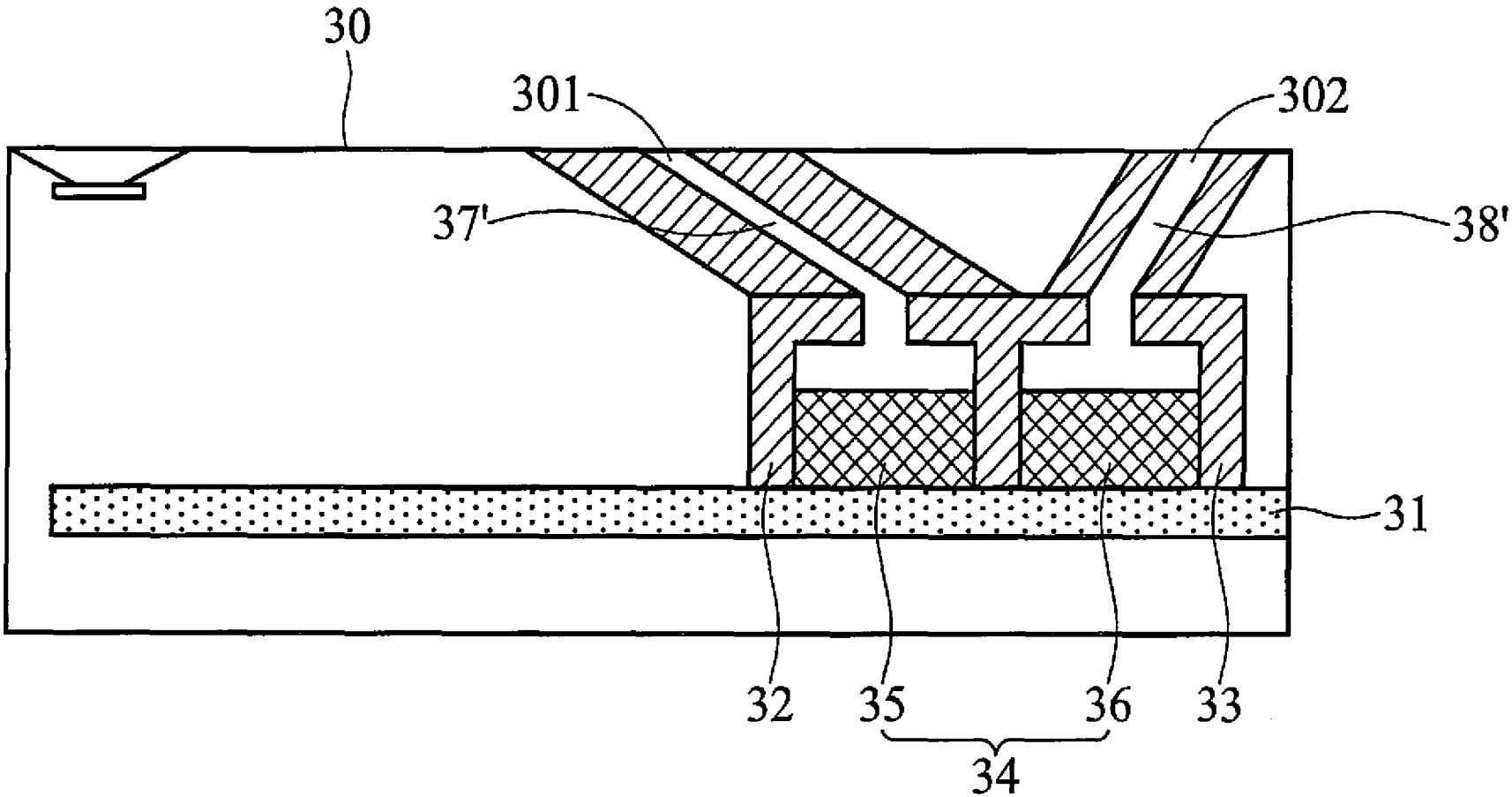
FIG. 4 depicts an electronic device in accordance with another embodiment of the invention.

The guide tubes 37 and 38 are equal in length, thus, the delay in sound propagating through the guide tubes 37 and 38 is equal. In some cases, however, the lengths of the guide tubes cannot be equal due to design constraints by the location of the PCB or the shape of the housing. FIG. 4 depicts an electronic device in accordance with another embodiment of the invention, wherein the same reference will be used for elements identical or similar to those shown in FIG. 3. In FIG. 4, the guide tubes 37' and 38' are not equal in length.

Figure 5:
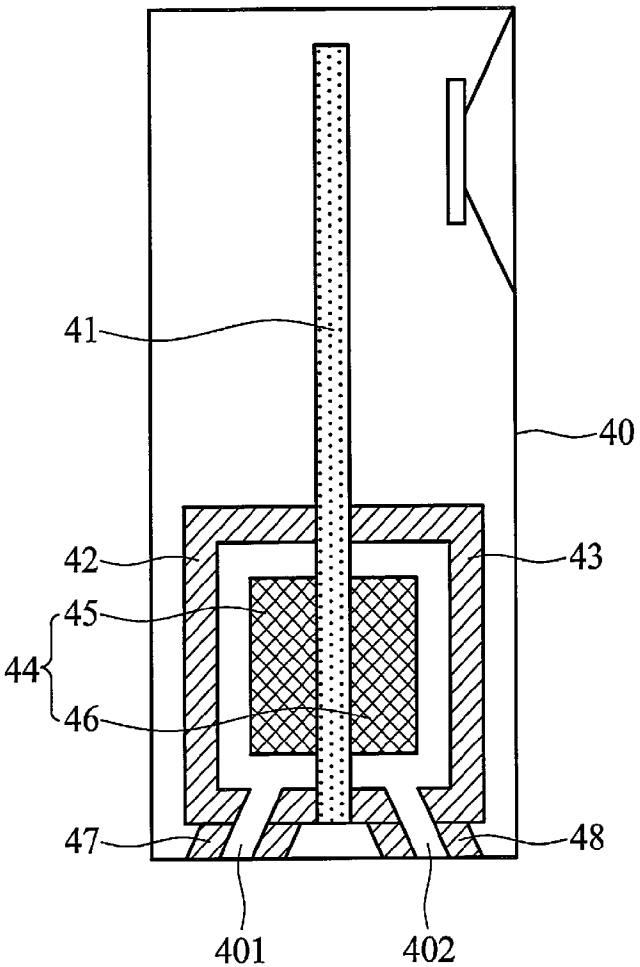
FIG. 5 depicts an electronic device in accordance with another embodiment of the invention.

Referring to FIG. 5, an electronic device in accordance with another embodiment of the invention comprises a housing 40, a printed circuit board (PCB) 41, a plurality of microphones 45 and 46, a plurality of chambers 42 and 43, and a plurality of guide tubes 47 and 48. All of the elements 41, 42, 43, 45, 46, 47, and 48 are disposed in the housing 40.

In this embodiment, the microphones 45 and 46 are omni-directional and disposed in the chambers 42 and 43 in a one-to-one manner. The guide tubes 47 and 48 are equal in length and extend from the chambers 42 and 43 to the acoustic openings 401 and 402 of the housing 40. Thus, the microphones 45 and 46 are capable of receiving external sound via the guide tubes 47 and 48. The chambers 42 and 43 are acoustically isolated from each other to prevent sound transmission therebetween.

The microphones 45 and 46 are surface-mounted on opposite sides of the PCB 41 (i.e. back-to-back) and placed in alignment. The microphones 45 and 46 constitute a microphone array 44. The directivity of the microphone array 44 is determined by the acoustic openings 401 and 402 rather than the microphones 45 and 46. In this embodiment, the acoustic openings 401 and 402 are provided at the bottom of the housing 40.

Figure 6:
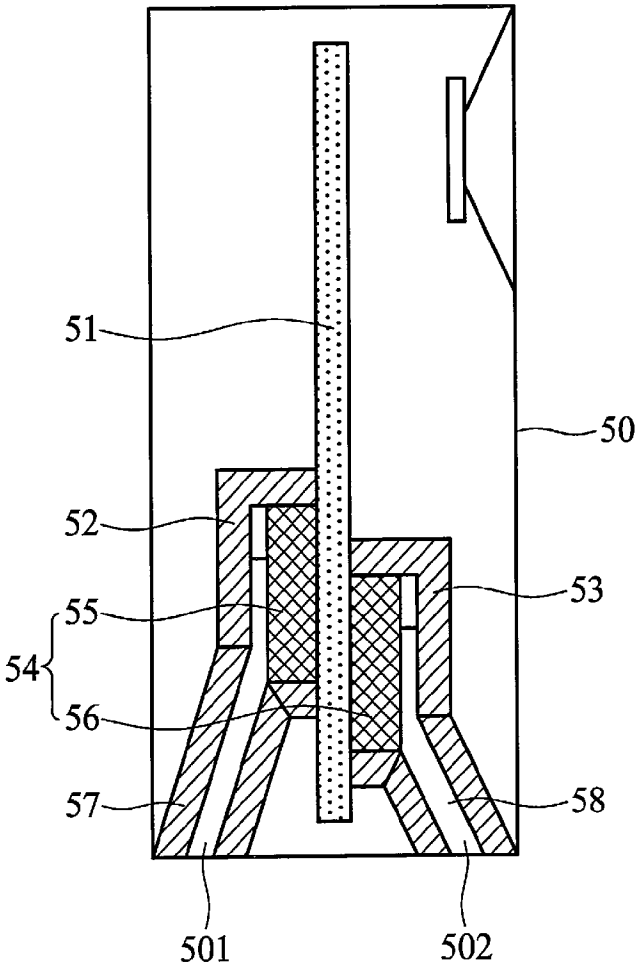
FIG. 6 depicts an electronic device in accordance with another embodiment of the invention.

Referring to FIG. 6, an electronic device in accordance with another embodiment of the invention comprises a housing 50, a printed circuit board (PCB) 51, a plurality of microphones 55 and 56, a plurality of chambers 52 and 53, and a plurality of guide tubes 57 and 58. All of the elements 51, 52, 53, 55, 56, 57, and 58 are disposed in the housing 50.

The microphones 55 and 56 are omni-directional and disposed in the chambers 52 and 53 in a one-to-one manner. The guide tubes 57 and 58 extend from the chambers 52 and 53 to the acoustic openings 501 and 502 of the housing 50, wherein the acoustic openings 501 and 502 are provided at the bottom of the housing 50. Thus, the microphones 55 and 56 are capable of receiving external sound via the guide tubes 57 and 58. The chambers 52 and 53 are acoustically isolated from each other to prevent sound transmission therebetween.

In this embodiment, the chambers 52 and 53 are separated from the bottom of the housing 50 by different distances. Thus, the guide tubes 57 and 58, extending from the acoustic openings 501 and 502 of the housing 50 to the chambers 52 and 53, are not equal in length.

The microphones 55 and 56 are surface-mounted on opposite sides of the PCB 51 and not placed in alignment. The microphones 55 and 56 constitute a microphone array 54. The directivity of the microphone array 54 is determined by the acoustic openings 501 and 502 rather than the microphones 55 and 56.

Figure 7A:
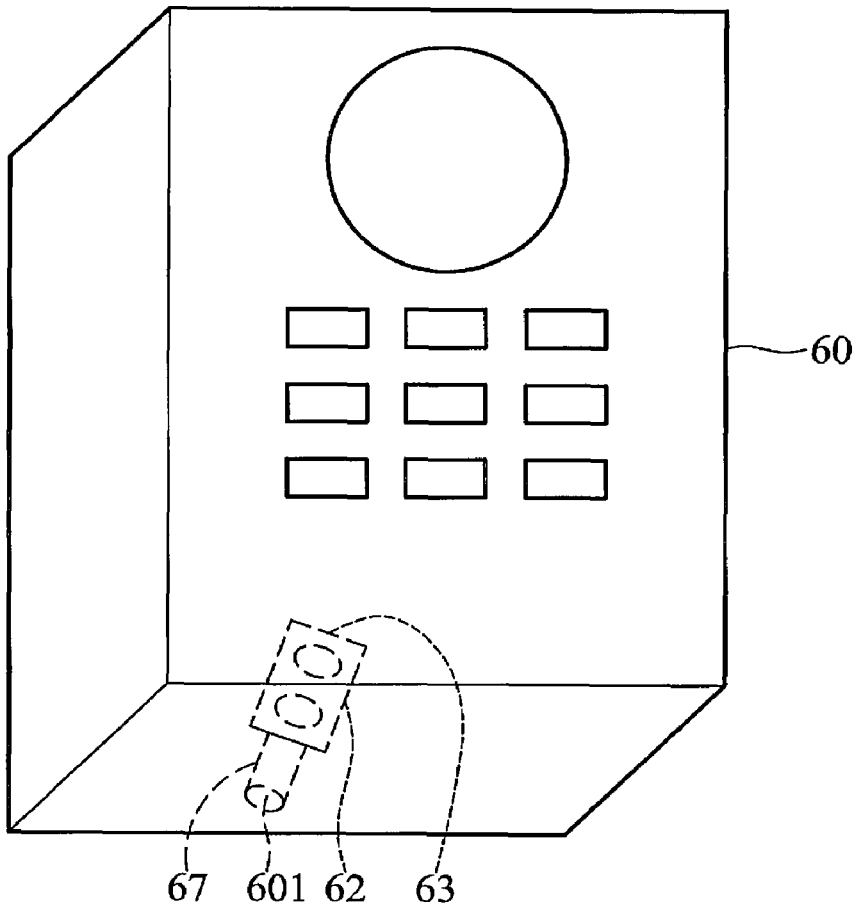
FIG. 7A depicts an electronic device in accordance with another embodiment of the invention.
Figure 7B:
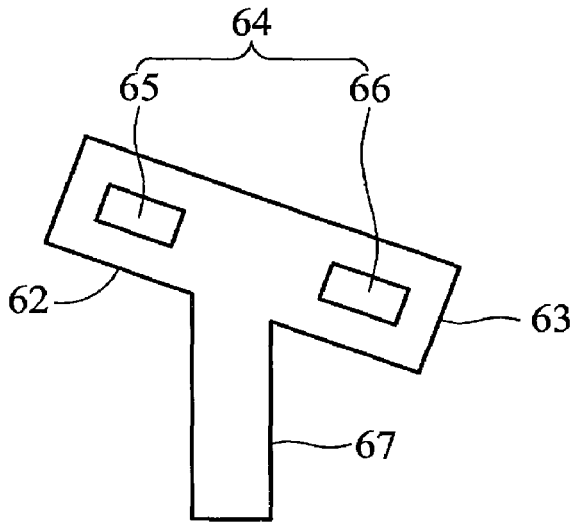
FIG. 7B depicts a microphone array disposed in a chamber of the electronic device of FIG. 7A.

Referring to FIGS. 7A and 7B, an electronic device in accordance with another embodiment of the invention comprises a housing 60, a plurality of microphones 65 and 66, a chamber 62, a port 63, and a guide tube 67. All of the elements 62, 63, 65, 66, and 67 are disposed in the housing 60. There are two ports, one is at the end of the guide tube 67 and the other 63 is in front of the microphone facing the front of the electronic device.

The microphones 65 and 66 are omni-directional, disposed in the chamber 62, and constitute a microphone array 64. The guide tube 67 extends from the chamber 62 to the acoustic opening 601 of the housing 60, wherein the acoustic opening 601 is provided at the rear of the housing 60. Thus, the microphones 65 and 66 are capable of receiving external sound via the guide tube 67 and the port 63.

In this embodiment, the chamber 62 and the microphones 65 and 66 therein are arranged at an inclined angle to the rear of the housing 60.

Figure 8:
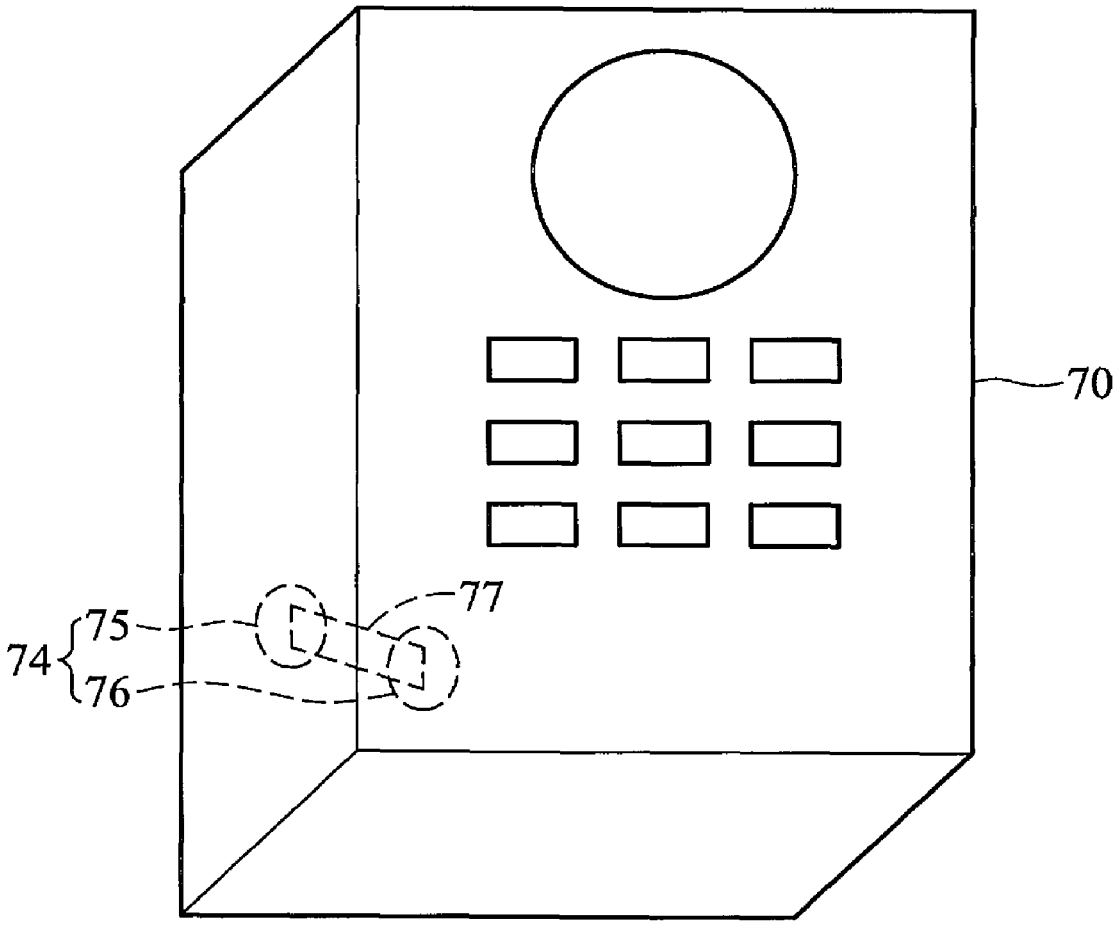
FIG. 8 depicts an electronic device in accordance with another embodiment of the invention.

FIG. 8 depicts an electronic device in accordance with another embodiment of the invention, wherein a microphone array 74 comprising microphones 75 and 76 is disposed in the housing 70 of the electronic device. External sound is introduced to a tunnel 77 and then to the microphones 75 and 76.

In the invention, the guide tubes allow a microphone array to receive external sound. Although the microphone array is disposed in a housing, the quality of audio signals received by the microphone array is not influenced by such disposition. Furthermore, the directivity of the microphone array is determined by the acoustic openings of the housing rather than the microphones on a PCB. Thus, directivity of the microphone array and capability thereof to satisfy practical demands is achievable and flexible. It is understood that the invention is applicable to a variety of electronic devices including a cellular phone, an audio recorder, a personal digital assistant (PDA), and others.

In the embodiments, the microphone array includes omni-directional microphones. It is understood, however, that the microphone array can include uni-directional microphones, omni-directional microphones, or combinations thereof.

It is understood that the acoustic openings can be provided on the top, bottom, or sides of the housing of the electronic device.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microphone array in an electronic device, comprising:
- a housing;
- a plurality of microphones disposed in the housing;
- a plurality of guide tubes extending from the housing toward the plurality of microphones; and
- a plurality of chambers disposed in the housing and acoustically isolated from each other to prevent sound transmission therebetween, wherein the plurality of microphones are disposed in the plurality of chambers in a one-to-one manner.

2. The microphone array as claimed in claim 1, wherein the housing comprises a plurality of acoustic openings, and the plurality of guide tubes extend from the plurality of acoustic openings to the plurality of chambers.

3. The microphone array as claimed in claim 2, wherein the plurality of acoustic openings are separated by a first distance, and the plurality of microphones are separated by a second distance less than the first distance.

4. The microphone array as claimed in claim 1, wherein the plurality of microphones comprise uni-directional microphones, omni-directional microphones, or combinations thereof.

5. The microphone array as claimed in claim 1, wherein the plurality of guide tubes are equal in length.

6. The microphone array as claimed in claim 1, wherein the plurality of guide tubes are different in length.

7. The microphone array as claimed in claim 1, wherein the electronic device is a cellular phone.

8. The microphone array as claimed in claim 1, wherein the electronic device is an audio recorder.

9. The microphone array as claimed in claim 1, wherein the electronic device is a personal digital assistant.

10. The microphone array as claimed in claim 1, further comprising a circuit board, wherein the plurality of microphones are placed on the same side of the circuit board.

11. The microphone array as claimed in claim 10, further comprising a circuit board, wherein the plurality of microphones are placed side-by-side.

12. The microphone array as claimed in claim 1, further comprising a circuit board, wherein the plurality of microphones are placed on opposite sides of the circuit board.

13. The microphone array as claimed in claim 12, further comprising a circuit board, wherein the plurality of microphones are placed back-to-back.

14. The microphone array as claimed in claim 13, wherein the plurality of microphones are in alignment.

15. The microphone array as claimed in claim 13, wherein the plurality of microphones are out of alignment.

* * * * *